US007703845B2

(12) United States Patent
Smith et al.

(10) Patent No.: US 7,703,845 B2
(45) Date of Patent: Apr. 27, 2010

(54) SADDLE-ADJUSTING MECHANISM OF A FITNESS APPARATUS

(75) Inventors: Jeffrey A. Smith, Ft. Lauderdale, FL (US); Leao Wang, 13F, No. 23, Jiun-Ho Street, Beitun District, Taichung (TW) 406

(73) Assignee: Leao Wang, Taichung (TW)

( * ) Notice: Subject to any disclaimer, the term of this patent is extended or adjusted under 35 U.S.C. 154(b) by 107 days.

(21) Appl. No.: 12/117,736

(22) Filed: May 8, 2008

(65) Prior Publication Data

US 2009/0278017 A1 Nov. 12, 2009

(51) Int. Cl.
*A63B 22/08* (2006.01)
*A63B 69/16* (2006.01)
*B62J 1/00* (2006.01)

(52) U.S. Cl. ..... 297/195.11; 297/215.13; 297/215.14; 482/57

(58) Field of Classification Search ..... 297/195.11, 297/215.13, 215.14, 215.15, 338, 340, 344.1, 297/344.11, 344.14, 354.1, 354.12, 195.1; 482/57, 62, 142

See application file for complete search history.

(56) References Cited

U.S. PATENT DOCUMENTS

| | | | | |
|---|---|---|---|---|
| 4,586,706 | A * | 5/1986 | Chen | 482/62 |
| 5,312,311 | A * | 5/1994 | Pearson | 482/57 |
| 5,971,894 | A * | 10/1999 | Chen | 482/57 |
| 6,913,560 | B2 * | 7/2005 | Ryan et al. | 297/215.13 X |
| 7,485,080 | B1 * | 2/2009 | Chuang et al. | 482/142 |
| 7,488,033 | B1 * | 2/2009 | Wang | 297/195.11 |
| 2005/0206204 | A1 * | 9/2005 | Ogawa et al. | 297/215.14 |
| 2008/0238160 | A1 * | 10/2008 | Huyck et al. | 297/195.11 |
| 2008/0238161 | A1 * | 10/2008 | Huyck et al. | 297/215.13 |

* cited by examiner

*Primary Examiner*—Rodney B White

(57) ABSTRACT

A saddle-adjusting mechanism of a fitness apparatus having: a) a set of upper and lower parallel slide rails pivotally attached to a front and a rear connecting rod; and b) a saddle support with guide rollers and an engaging gear such that the upper and lower parallel slide rails may be adjusted at a certain angle. Meanwhile, a saddle can be moved forward and backward and maintained at a certain angle so that the operators have a comfortable sitting. Moreover, a back pad support is installed in such a way that a fine adjustment of the backing angle of a back pad is achieved by moving it upward and downward.

4 Claims, 7 Drawing Sheets

SADDLE-ADJUSTING MECHANISM OF A FITNESS APPARATUS

BACKGROUND OF THE INVENTION

1. Fields of the Invention

The invention relates to a saddle-adjusting mechanism of a fitness apparatus, and more particularly, to a structure for conducting any adjustment of the saddle, thereby meeting different requirements of sitting and lying position.

2. Description of the Related Art

It is well known that many fitness apparatuses (such as fitness bikes, rowing exerciser, etc.) have saddles disposed thereon so that the operator can sit thereon for performing an exercise session. In order to achieve a smooth operation of the fitness apparatus for operators having different heights, the saddles have been designed to be position-adjustable.

At present, the conventional saddle-adjusting mechanism can only achieve an vertical or inclined-vertical adjustment. In this way, the operator has to be forced to accept a single exercise position according to his height. This exercise position does not necessarily meet the requirements on sitting comfort and height. However, the operator does not have other choices. Therefore, the conventional mechanism requires further improvements.

SUMMARY OF THE INVENTION

A primary object of the invention is to provide a saddle-adjusting mechanism of a fitness apparatus whose saddle can be moved upward and downward as well as forward and backward without affect the sitting angle. Even, the back pad can perform an automatic fine adjustment of the backing angle according to different height of the saddle. Accordingly, a practical use is fully ensured.

According to the invention, a saddle-adjusting mechanism of a fitness apparatus includes: a) a set of upper and lower parallel slide rails pivotally attached to a front and a rear connecting rod; and b) a saddle support with guide rollers and an engaging gear such that the upper and lower parallel slide rails may be adjusted at a certain angle. Meanwhile, a saddle can be moved forward and backward and maintained at a certain angle so that the operators have a comfortable sitting. Moreover, a back pad support is installed in such a way that a fine adjustment of the backing angle of a back pad is achieved by moving it upward and downward.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
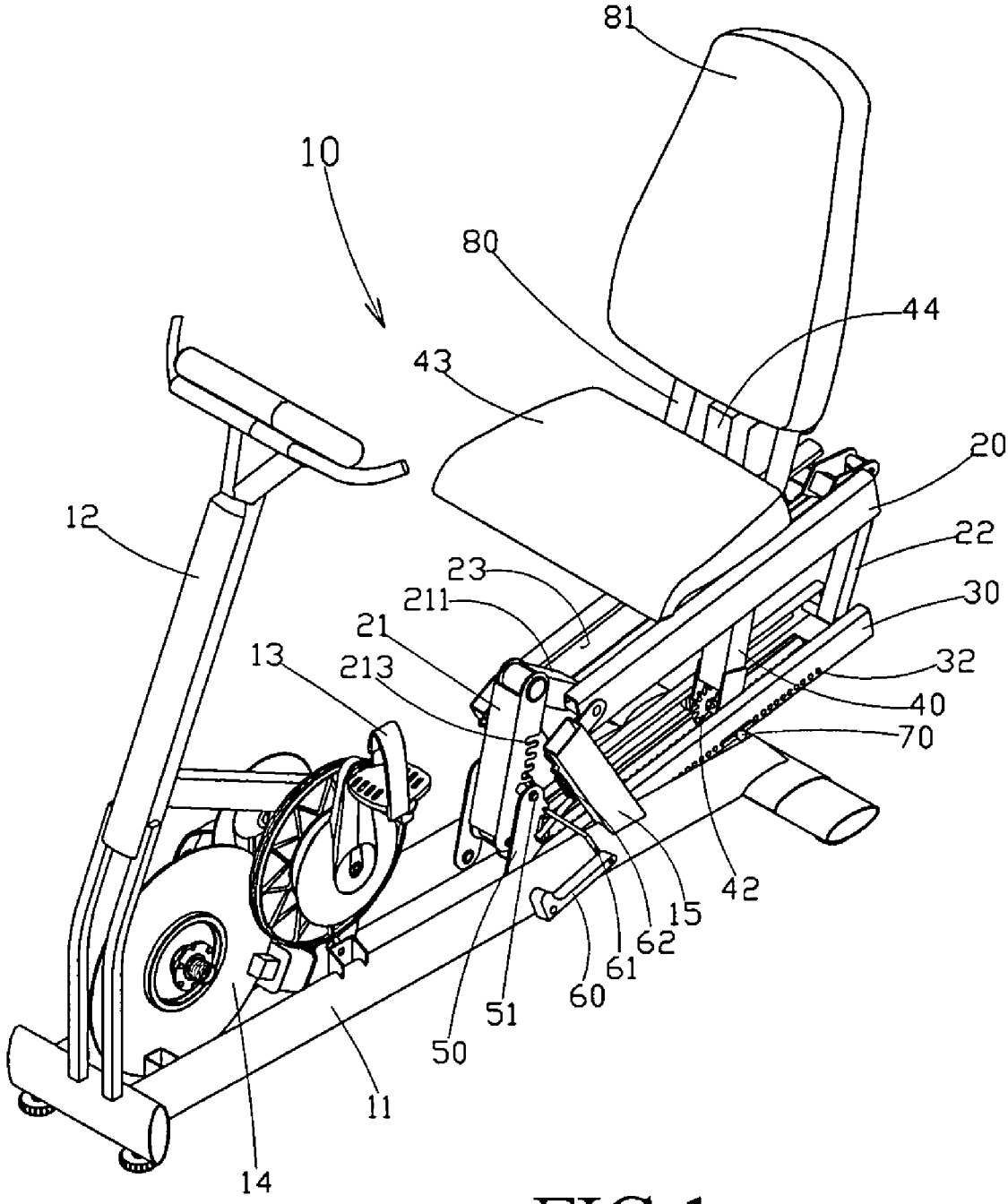
FIG. 1 is a perspective view of a first embodiment of the invention.
Figure 2:
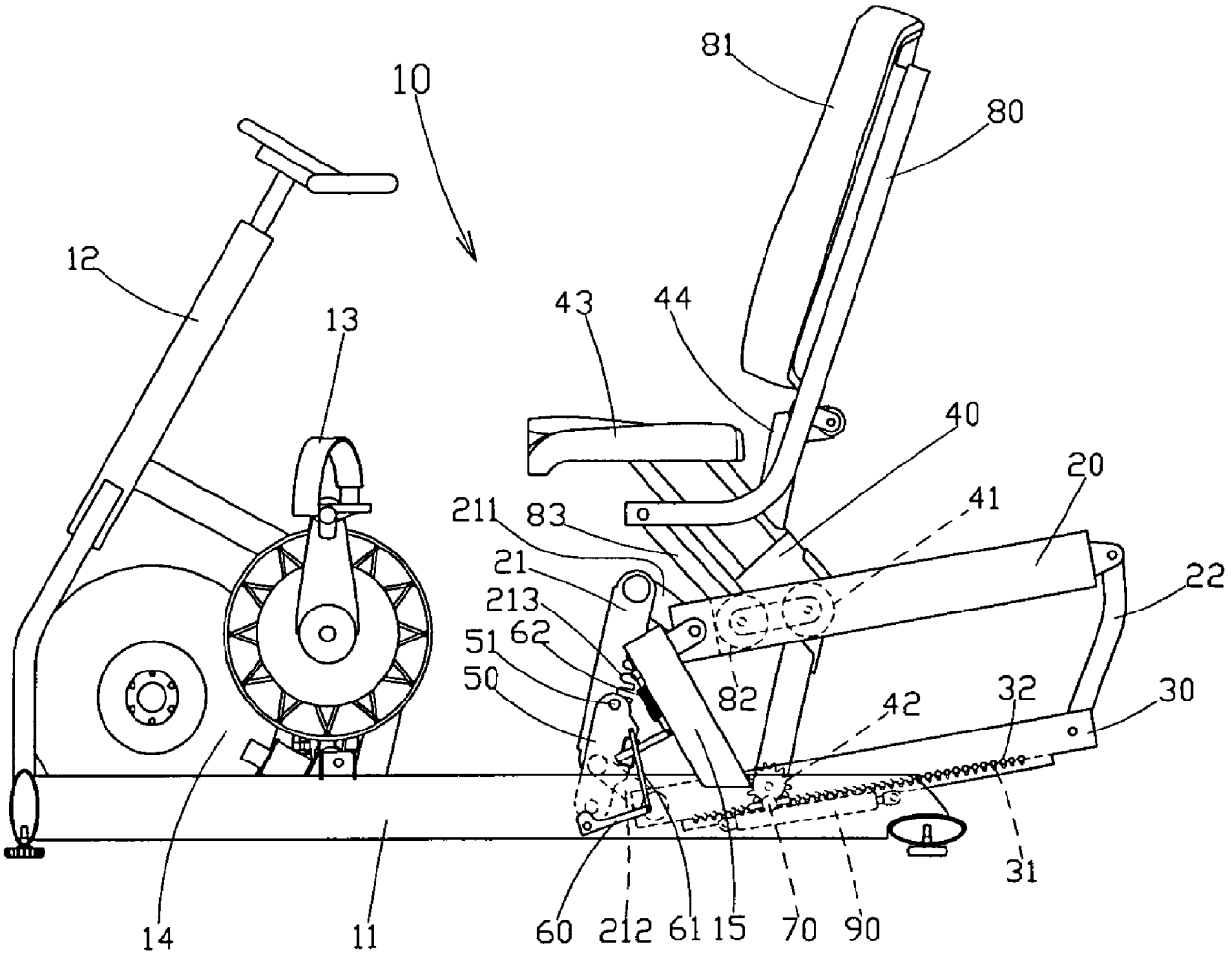
FIG. 2 is a side view of the embodiment of the invention according to FIG. 1.
Figure 3:
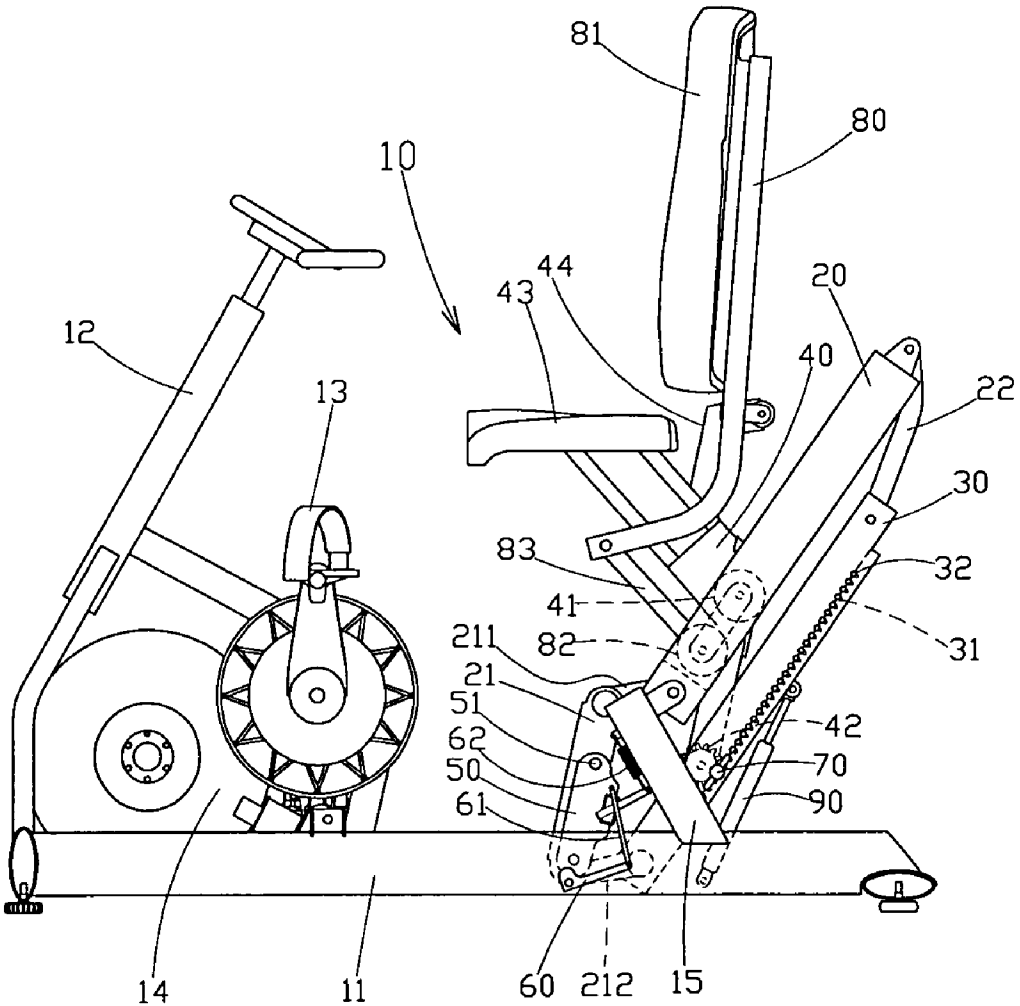
FIG. 3 is a side view of the embodiment of the invention according to FIG. 2, illustrating an adjustment thereof.

Referring to FIGS. 1 through 3, illustrating a preferred embodiment of a fitness bike 10, the fitness bike 10 includes a base 11. A handrail support 12 and a power treading assembly 14 having a pedal 13 are disposed at a front side of the base 11. Theses elements belong to the prior art so that no further descriptions thereto are given hereinafter. Two seat supports 15 are installed near the middle section of the base 11. The seat supports 15 are provided with a upper and lower parallel guide rail 20, 30 at the center thereof. The upper and lower parallel guide rails 20, 30 are pivotally attached to a front and a rear connecting rod 21, 22. The internal side of the upper parallel guide rail 20 includes a slide groove 23 while the bottom of the lower parallel guide rail 30 is provided with a toothed groove 31. In this way, a saddle support 40 with guide rollers 41 at both sides thereof and an engaging gear 42 at the bottom thereof may be installed therein such that the saddle support 40 can be moved forward and backward. Of course, a saddle 43 is fastened at the top of the saddle support 40.

Figure 4:
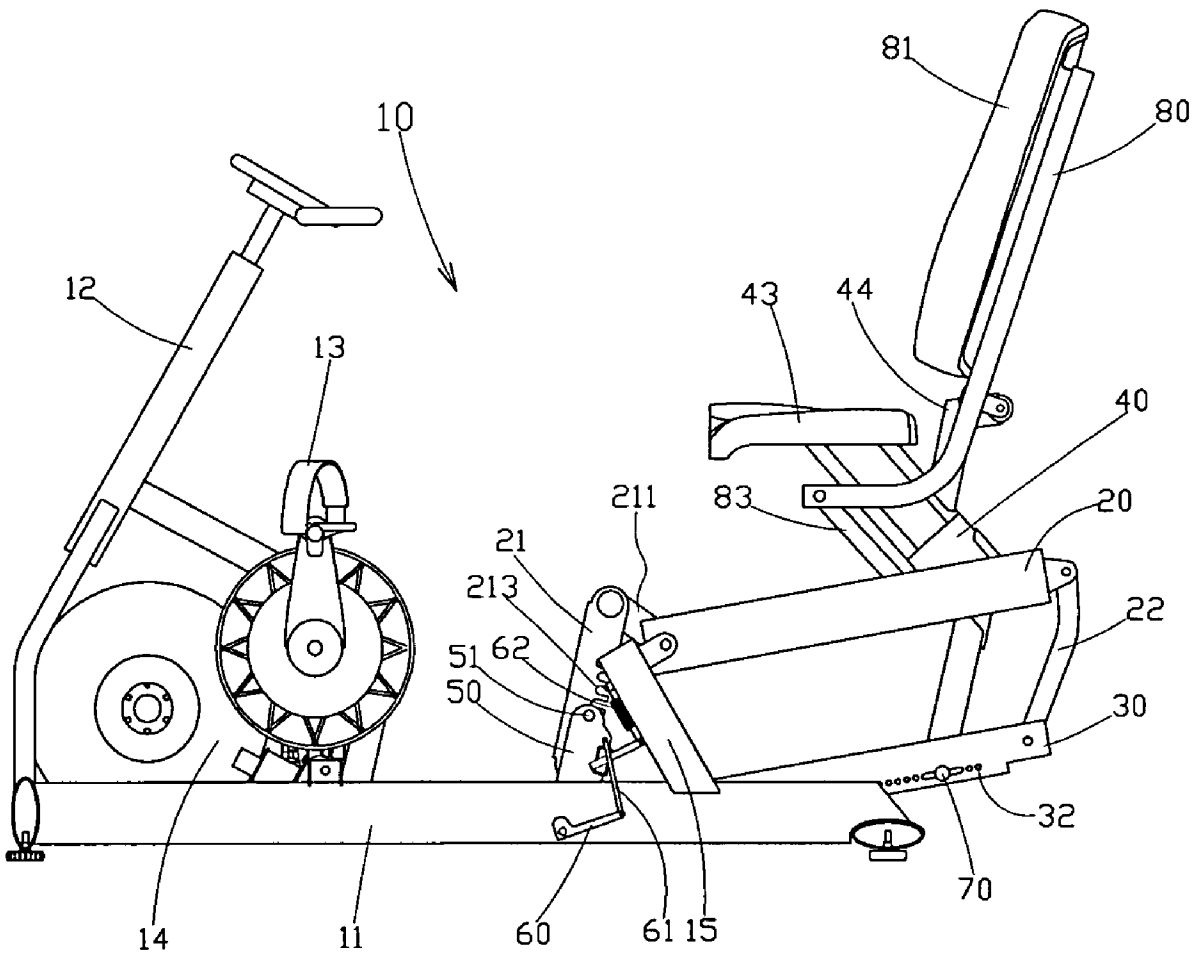
FIG. 4 is a side view of the embodiment of the invention according to FIG. 1, illustrating the position of another saddle.
Figure 5:
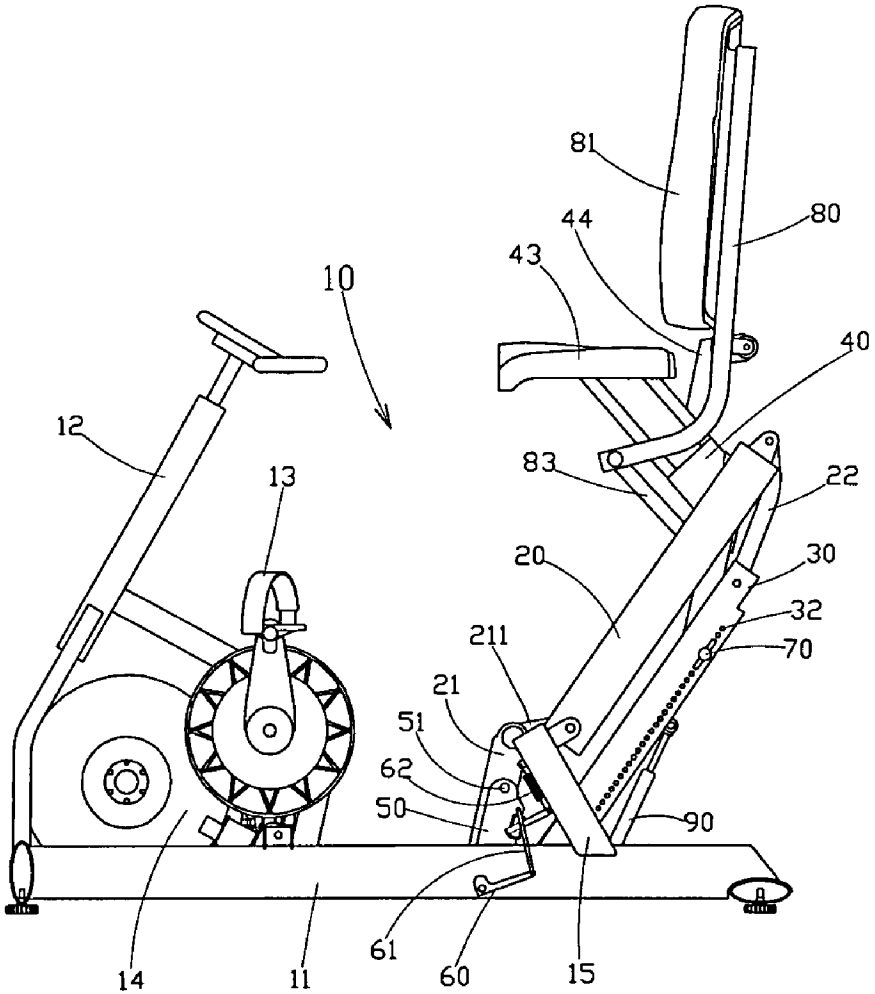
FIG. 5 is a side view of the embodiment of the invention according to FIG. 4, illustrating an adjustment thereof.

As shown in FIGS. 4 and 5, the front connecting rod 21 employs a top and bottom auxiliary connecting rod 211, 212 for a pivotal connection with the upper and lower parallel guide rails 20, 30 such that the upper and lower parallel guide rail 20, 30 may conduct an adjustment at a certain angle. In this way, both of the guide rails 20, 30 can be maintained in a parallel position. Moreover, the saddle 43 can be kept at a certain angle for the operators to have a comfortable sitting. As a result, the fitness bike 10 serves as a so-called horizontal type fitness bike when the upper and lower parallel slide rails 20, 30 are located at a lower position (see FIGS. 2 and 4). The horizontal type fitness bike allows the operator's feet to tread forward. Besides, the fitness bike 10 serves as a so-called vertical type fitness bike when the upper and lower parallel slide rails 20, 30 are located at a higher position (see FIGS. 3 and 5). The vertical type fitness bike allows the operator's feet to tread downward.

Figure 6:
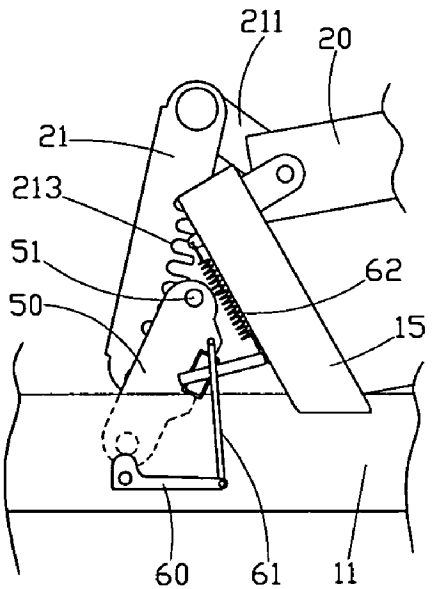
FIG. 6 is an enlarged view of an engaging piece in accordance with the invention, illustrating the actuation thereof.

Furthermore, a plurality of engaging recesses 213 is formed at one side of the front connecting rod 21 and matched with an engaging piece 50 having an engaging claw 51 for determining the angle and the position thereof. As shown in FIG. 6, when the angle of the upper and lower parallel slide rails 20, 30 is adjusted, a treading switch 60 has to be compressed in such a way that the pull rod 61 at the other end pulls the engaging piece 50 in rotation and the engaging claw 51 is detached from the engaging recess 213. After the adjustment, an engaged state is re-created by use of the resilience of an elastic element 62.

In order to facilitate the adjustment of the upper and lower parallel slide rails 20, 30, an auxiliary push element 90 is provided for an auxiliary lifting action.

Figure 7:
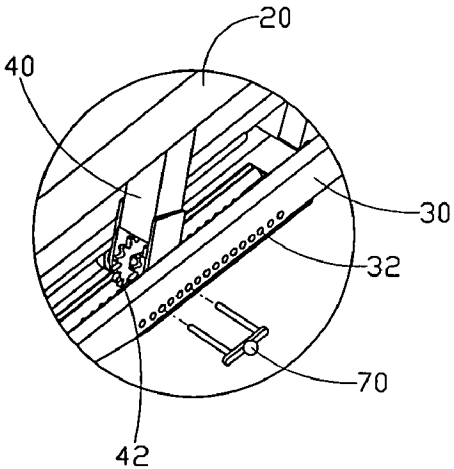
FIG. 7 is an enlarged view of an insertion element in accordance with the invention, illustrating the actuation thereof.

Referring to FIG. 7, a plurality of through holes 32 is regularly arranged at one side of the lower parallel slide rail 30 such that an insertion element 70 may be extended into a corresponding toothed groove 31 of the lower parallel slide rail 30 for an effective positioning of the engaging gear 42. Thus, the insertion element 70 has to be removed when the position of the saddle support 40 is adjusted by moving it forward and backward. After the adjustment, the insertion element 70 is re-inserted into a corresponding through hole 32 of the engaging gear 42.

Figure 8:
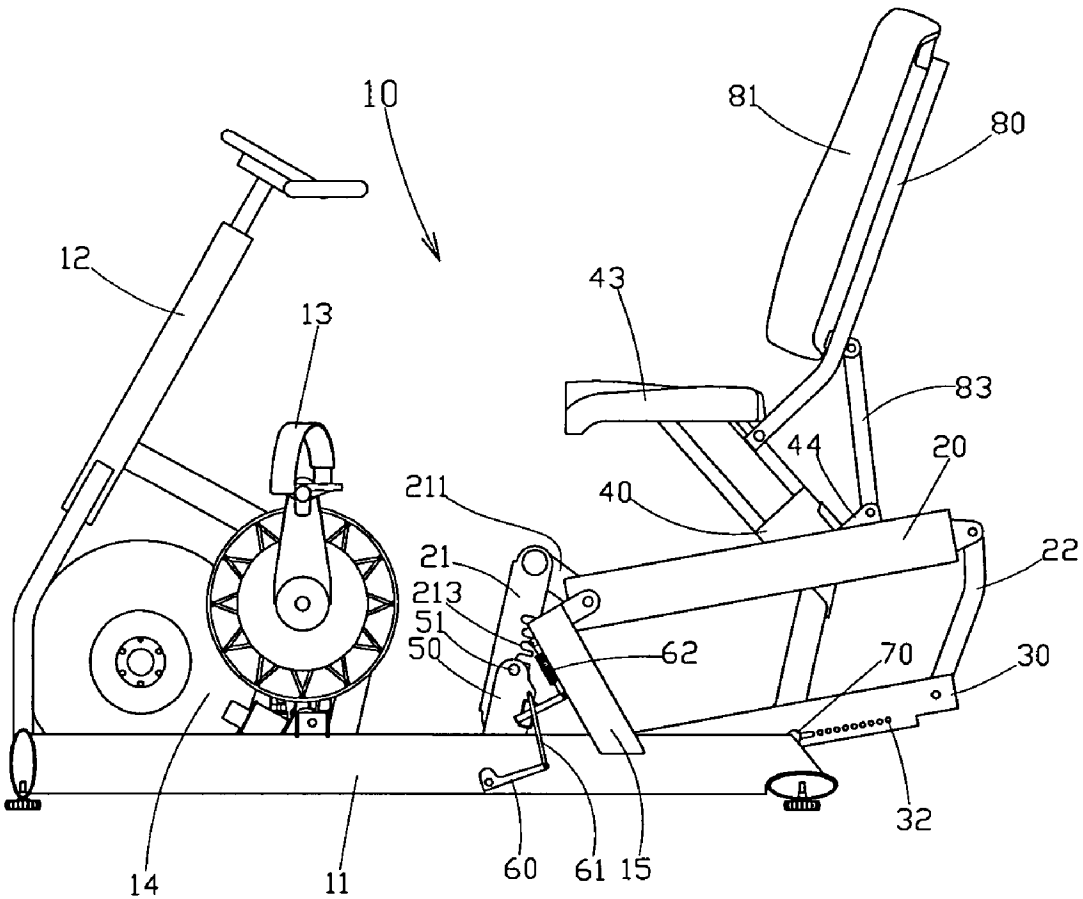
FIG. 8 is a side view of another embodiment of the invention.

In fact, a back pad support 80 having a back pad 81 is pivotally attached to a branched post 44 of the saddle support 40. Moreover, a coupling rod 83 having a guide roller 82 is pivotally coupled to the bottom of the back pad support 80 such that the coupling rod 83 may synchronically move within the slide groove 23 of the upper parallel slide rail 20. In this way, an effective fine adjustment of the backing angle of the back pad 81 is achieved. The change of the angle is shown in FIGS. 2 and 3 or in FIGS. 4 and 5. According to another embodiment of the invention in FIG. 8, the back pad support 80 and the coupling rod 83 having the guide roller 82 may be installed at the rear side of the saddle support 40 as well. In this way, the expected fine adjustment effect of the back pad 81 may be also achieved.

Figure 9:
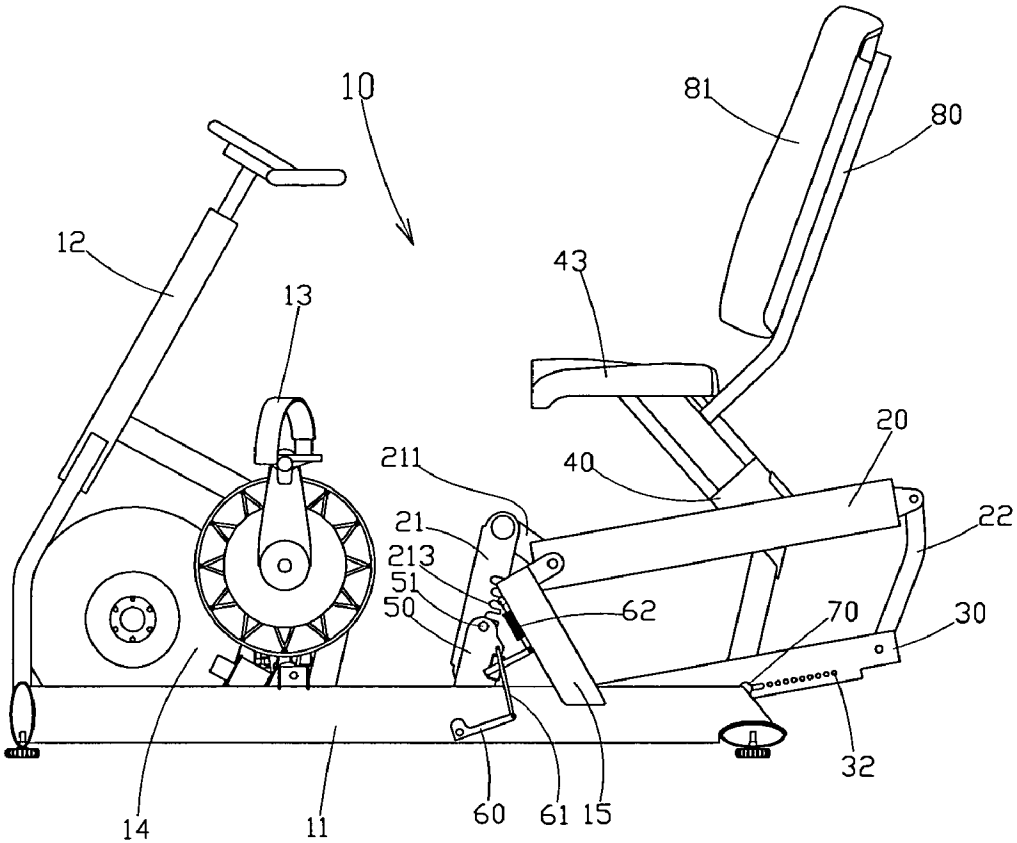
FIG. 9 is a perspective view of a further embodiment of the invention.

As shown in FIG. 9, the angle of the back pad 81 of the invention is fixed. In other words, the backing angle is not changed with the displacement of the saddle 43. Meanwhile, this embodiment won't affect the sitting comfort.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A saddle-adjusting mechanism of a fitness apparatus installed at a saddle support of a fitness apparatus and comprising a set of upper and lower parallel slide rails and a saddle support disposed within the upper and lower parallel slide rails, wherein the upper and lower parallel slide rails are pivotally attached to a front and a rear connecting rod, and an internal side of the upper parallel guide rail includes a slide groove while a bottom of the lower parallel guide rail is provided with a toothed groove, and wherein a plurality of through holes is regularly arranged at one side of the lower parallel slide rail such that a insertion element may be extended into a corresponding toothed groove of the lower parallel slide rail for an effective positioning of an engaging gear of the saddle support, and wherein the front connecting rod employs a top and bottom auxiliary connecting rod for a pivotal connection with the upper and lower parallel guide rails, and wherein a plurality of engaging recesses is formed at one side of the front connecting rod and matched with an engaging piece having an engaging claw for determining an angle and a position of the front connecting rod, and wherein the saddle support includes a saddle at a top thereof while guide rollers are disposed at both sides of a middle section of the saddle support for sliding in the upper parallel slide rail, and wherein a saddle support is provided with an engaging gear at a bottom thereof for moving in the lower parallel slide rail, wherein the upper and lower parallel slide rails may conduct an adjustment at a desired angle and the saddle can be moved forward and backward for maintaining at a desired angle so that the operators have a comfortable sitting.

2. The saddle-adjusting mechanism of a fitness apparatus as recited in claim 1, further comprising a treading switch operated at a first end so that a pull rod at a second end of the treading switch pulls the engaging piece in rotation and the engaging claw is detached from one of the plurality of engaging recesses, wherein an engaged state is re-created by use of a resilience of an elastic element after an adjustment.

3. The saddle-adjusting mechanism of a fitness apparatus as recited in claim 1, wherein a back pad support having a back pad is pivotally attached to a branched post of the saddle support, and wherein a coupling rod having a guide roller is pivotally coupled to a bottom of the back pad support such that the coupling rod may synchronically move within the slide groove of the upper parallel slide rail so that an effective fine adjustment of a backing angle of the back pad is achieved.

4. The saddle-adjusting mechanism of a fitness apparatus as recited in claim 1, wherein an auxiliary push element is provided between the upper and lower parallel slide rails.

* * * * *